US009822656B2

(12) United States Patent
Bricaud et al.

(10) Patent No.: US 9,822,656 B2
(45) Date of Patent: Nov. 21, 2017

(54) ROTOR ASSEMBLY FOR GAS TURBINE

(71) Applicant: ALSTOM Technology Ltd, Baden (CH)

(72) Inventors: Cyrille Bricaud, Rheinfelden (DE); Carlos Simon-Delgado, Baden (CH); Steffen Holzhaeuser, Nussbaumen (CH); Marco Lamminger, Ennetbaden (CH); Carl Berger, Wettingen (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 261 days.

(21) Appl. No.: 14/728,003

(22) Filed: Jun. 2, 2015

(65) Prior Publication Data

US 2015/0361813 A1 Dec. 17, 2015

(30) Foreign Application Priority Data

Jun. 11, 2014 (EP) ..... 14171917

(51) Int. Cl.

| | |
|---|---|
| ***F01D 11/00*** | (2006.01) |
| ***F01D 5/02*** | (2006.01) |
| ***F01D 5/32*** | (2006.01) |
| *F01D 5/30* | (2006.01) |

(52) U.S. Cl.

CPC ..... *F01D 11/006* (2013.01); *F01D 5/02* (2013.01); *F01D 5/3007* (2013.01); *F01D 5/3015* (2013.01); *F01D 5/326* (2013.01); *F01D 5/30* (2013.01); *F01D 11/005* (2013.01); *F05D 2200/263* (2013.01); *F05D 2220/32* (2013.01); *F05D 2240/55* (2013.01); *F05D 2250/192* (2013.01); *F05D 2250/38* (2013.01);

(Continued)

(58) Field of Classification Search

CPC . F01D 11/005; F01D 5/02; F01D 5/30; F01D 5/3007; F01D 5/3015; F01D 5/326; F01D 11/006; F05D 2200/263; F05D 2200/32; F05D 2240/55; F05D 2250/192; F05D 2250/38; F05D 2300/10; F05D 2300/43; F05D 2300/44

See application file for complete search history.

(56) References Cited

U.S. PATENT DOCUMENTS 3,807,898 A * 4/1974 Guy ..... F01D 5/3015 416/218
4,108,571 A * 8/1978 Mawson ..... F01D 5/3015 416/221

(Continued)

FOREIGN PATENT DOCUMENTS

| | | | |
|---|---|---|---|
| EP | 1 795 709 A2 | 6/2007 | |
| GB | 1 512 882 A | 6/1978 | |
| GB | 2194000 A * | 2/1988 | ..... F01D 5/3015 |

*Primary Examiner* — Woody Lee, Jr.
*Assistant Examiner* — Behnoush Haghighian
(74) *Attorney, Agent, or Firm* — Buchanan Ingersoll & Rooney PC

(57) ABSTRACT

The present invention relates to a rotor assembly for a rotary machine such as a gas turbine. The present solution provides a sealing wire located inside a groove engraved in the rotor body. The sealing wire is responsive to radial centrifugal forces acting during normal operation of the machine, and moves radially in the groove until a sealing configuration is achieved such to prevent damaging hot leakage towards machine components.

14 Claims, 6 Drawing Sheets

(52) U.S. Cl.
CPC ..... *F05D 2300/10* (2013.01); *F05D 2300/43* (2013.01); *F05D 2300/44* (2013.01)

(56) References Cited

U.S. PATENT DOCUMENTS

| | | | | | |
|---|---|---|---|---|---|
| 4,482,297 | A * | 11/1984 | Mosimann | F01D 5/22 | 416/215 |
| 5,257,909 | A * | 11/1993 | Glynn | F01D 5/3015 | 416/219 R |
| 7,371,050 | B2 * | 5/2008 | Pasquiet | F01D 5/3015 | 416/204 A |
| 8,128,371 | B2 * | 3/2012 | Ravi | F01D 5/3015 | 416/212 A |
| 2005/0232772 | A1 * | 10/2005 | Race | F01D 5/3015 | 416/198 A |
| 2013/0202433 | A1 * | 8/2013 | Hafner | F01D 5/3015 | 415/230 |

* cited by examiner

ROTOR ASSEMBLY FOR GAS TURBINE

CROSS-REFERENCE TO RELATED APPLICATIONS

This application claims priority to European application 14171917.9 filed Jun. 11, 2014, the contents of which are hereby incorporated in its entirety.

TECHNICAL FIELD

The present invention relates to a rotor assembly for a rotary machine such as a gas turbine.

BACKGROUND

As well known, a standard configuration for a gas turbine envisages a plurality of blades solidly inserted into a rotor body. In particular, each blade comprises a fir-tree root which is retained into a correspondent fir-tree portion of the rotor body. The outer portion of the blade comprises an airfoil, shaped in a way to convert the kinetic and pressure energy associated to the hot fluid flow evolving in the machine to mechanical energy available at the rotor shaft, the blade airfoil being integral to the blade fir-tree root by means of a blade shank portion interposed there between. The pressure and temperature which arise in rotor cavities positioned between subsequent blades cause a leakage of hot fluid towards the shank and fir-tree portions of the blades. Such occurrence causes overheating of the blade parts, leading to deterioration in time of such components.

To solve this problem, a lock plate is generally provided to shield the blade fir-tree root and the blade shank from the hot flow coming from the adjacent rotor cavity. The lower portion of the lock plate is usually inserted in a groove engraved in the rotor body, whilst the upper portion is embedded in hook-shaped portion provided in the blade platform edge.

However, even though such arrangement determines a leakage reduction, it fails in providing a definitive solution to the problem. In fact, during normal operation of the machine, a temperature and pressure gradient between the fir-tree root and shank portion of the blade and the adjacent rotor cavity is usually experienced, such that a very high leakage occurs. It will be appreciated that manufacture tolerances between interconnected components cannot guarantee a perfect tightness. As a result, notwithstanding the presence of the lock plate at the interface of the rotor cavity and blade parts, a leakage of hot flow is still experienced causing a damaging effect on the blades and affecting the overall performance in time of the machinery.

SUMMARY

According to preferred embodiments, which will be described in the following detailed description only for exemplary and non-limiting purposes, the present solution provides a sealing wire located inside the groove engraved in the rotor body. The sealing wire is responsive to radial centrifugal forces acting during normal operation of the machine, and moves radially in the groove until a sealing configuration is achieved.

This way the leakage of hot fluid towards the blade parts is significantly reduced with respect to the prior art, and a better performance of the blade materials in terms of integrity and endurance is thus obtained.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings, wherein.

DETAILED DESCRIPTION

Figure 1:
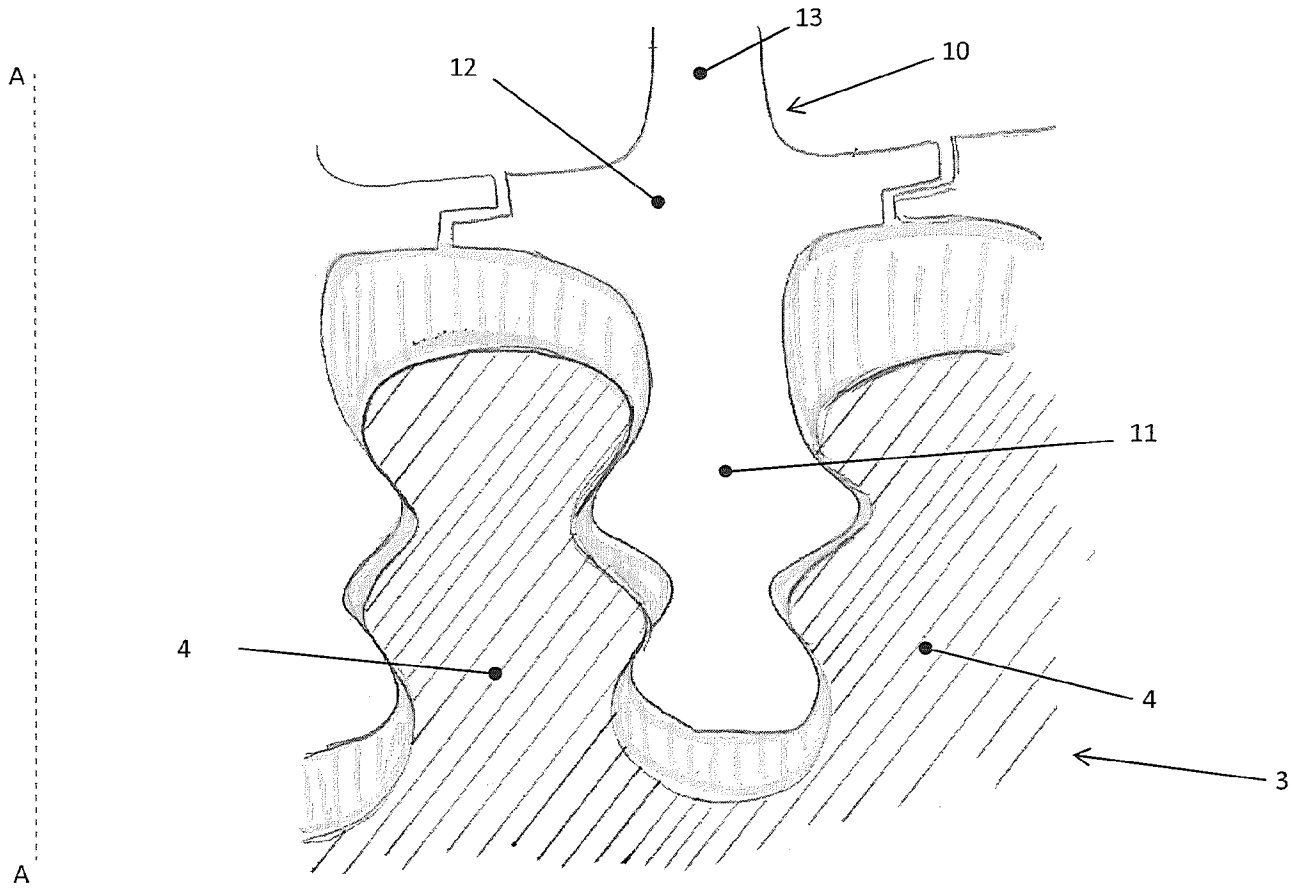
FIG. 1 is a front section view of a rotor-blade configuration according to the prior art.

With reference to FIG. 1, it is showed a front section view of a rotor-blade configuration according to the prior art. A blade, generally indicated with numeral reference 10, is fixed in a rotor body 3. More in particular, the blade 10 comprises a blade airfoil portion 13, a blade shank portion 12 and a blade fir-tree portion 11. The blade fir-tree portion is retained in a correspondent rotor fir-tree portion 4. Necessary tolerances between components inevitably determine gaps between the blade and the rotor (in the figure the size of such gaps is exaggerated for clarity purposes). Therefore a tight proof contact between fir-tree surfaces of blade and rotor body cannot be assured for the reasons above. Furthermore, in order to assure a secure locking of the blade within the rotor body large contact surfaces are required for providing the necessary friction between the parts, which increases the entity of existing gaps.

Figure 2:
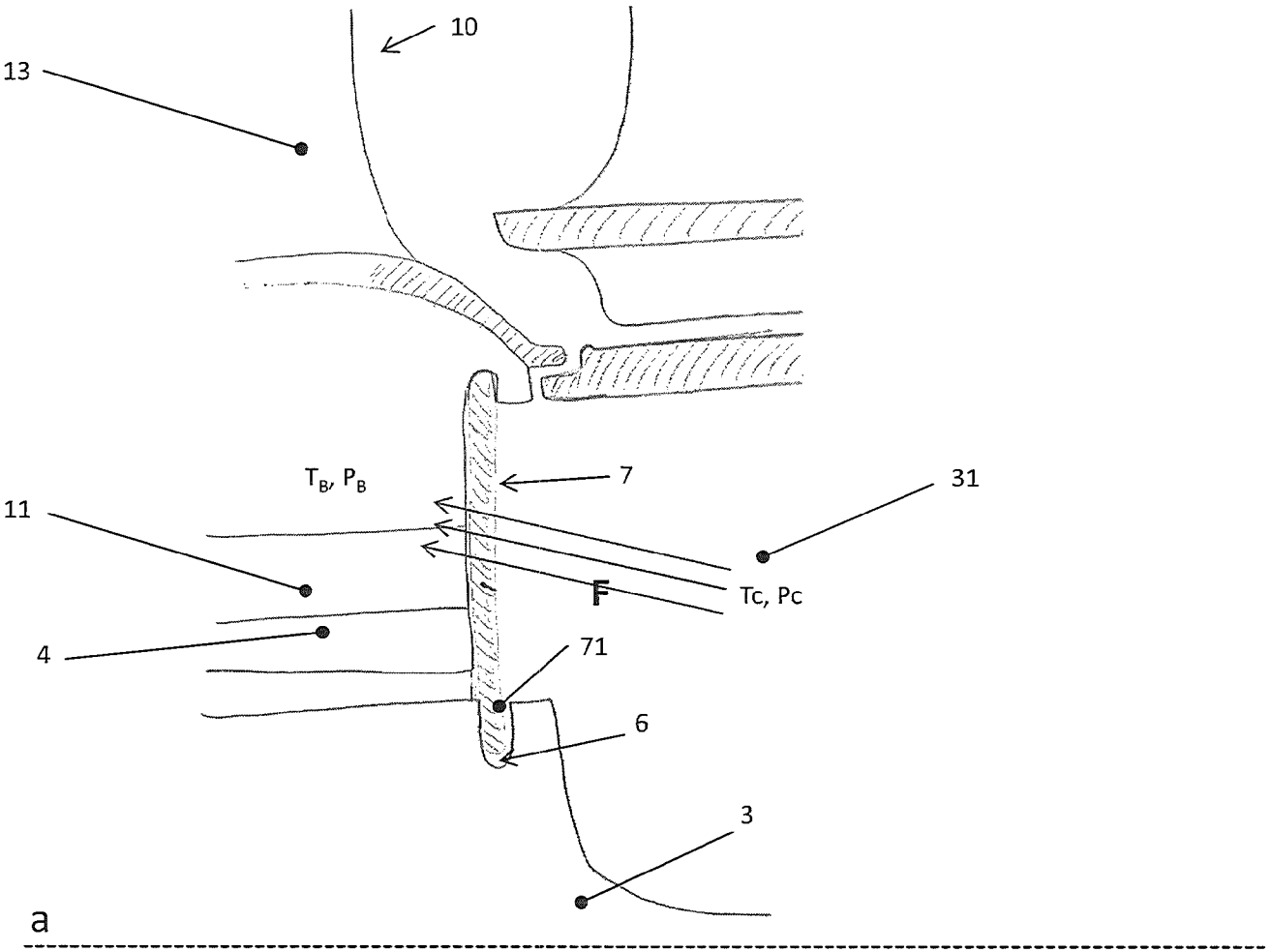
FIG. 2 is a side section view of the rotor-blade-lock plate configuration along line A-A.

With reference now to next FIG. 2, it is shown the arrangement of FIG. 1 along the side section view A-A. It is schematically showed the rotor 3, rotatable about an axis a, having the fir-tree portion 4 retaining correspondent blade fir-tree portion 11. Lateral section view reveals a rotor cavity 31, positioned between two subsequent blades along the direction of the axis a (of which only blade 10 is shown), wherein the temperature and pressure conditions (indicated as $T_c$ and $P_c$) are such to cause a hot flow leakage towards the blade (arrows F in the figure), in particular towards the fir-tree region where the latter is retained within the rotor body and temperature and pressure have values indicated as $T_B$ and $P_B$. To overcome this problem, according to known methodologies, a lock plate 7 is provided in order to shield the leakage generated by the temperature and pressure gradient between the rotor cavity 31 and the fir-tree regions 11 and 4 of the blade and the rotor body respectively. More in particular, the lock plate 7 comprises a lower portion 71 inserted in a circumferential groove 6 engraved in the rotor body 3, as schematically showed in the lateral cross section of FIG. 2. However, due to tolerances between parts in contact, leakage through the lock plate 7 still occurs, such that a hot flow reaches the blade fir-tree portion 11 affecting temperature and pressure $T_B$ and $P_B$.

Figure 3:
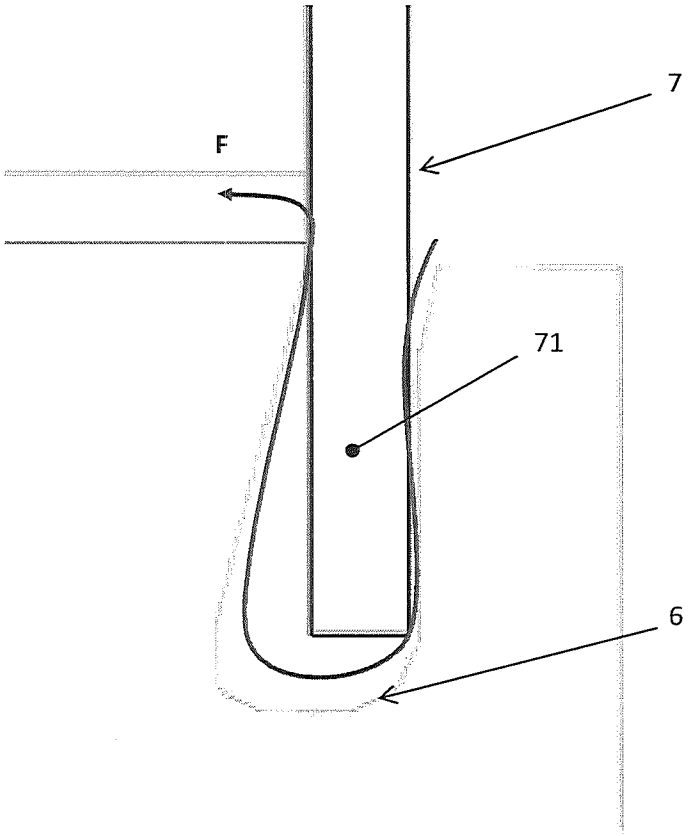
FIG. 3 shows a particular of FIG. 2.

FIG. 3 shows a detail of FIG. 2 focusing on the lower portion 71 of lock plate 7 inserted into the circumferential groove 6. Arrows F shows the path of the leakage going around the lock plate and reaching the blade and rotor fir-tree regions (not showed).

Figure 4:
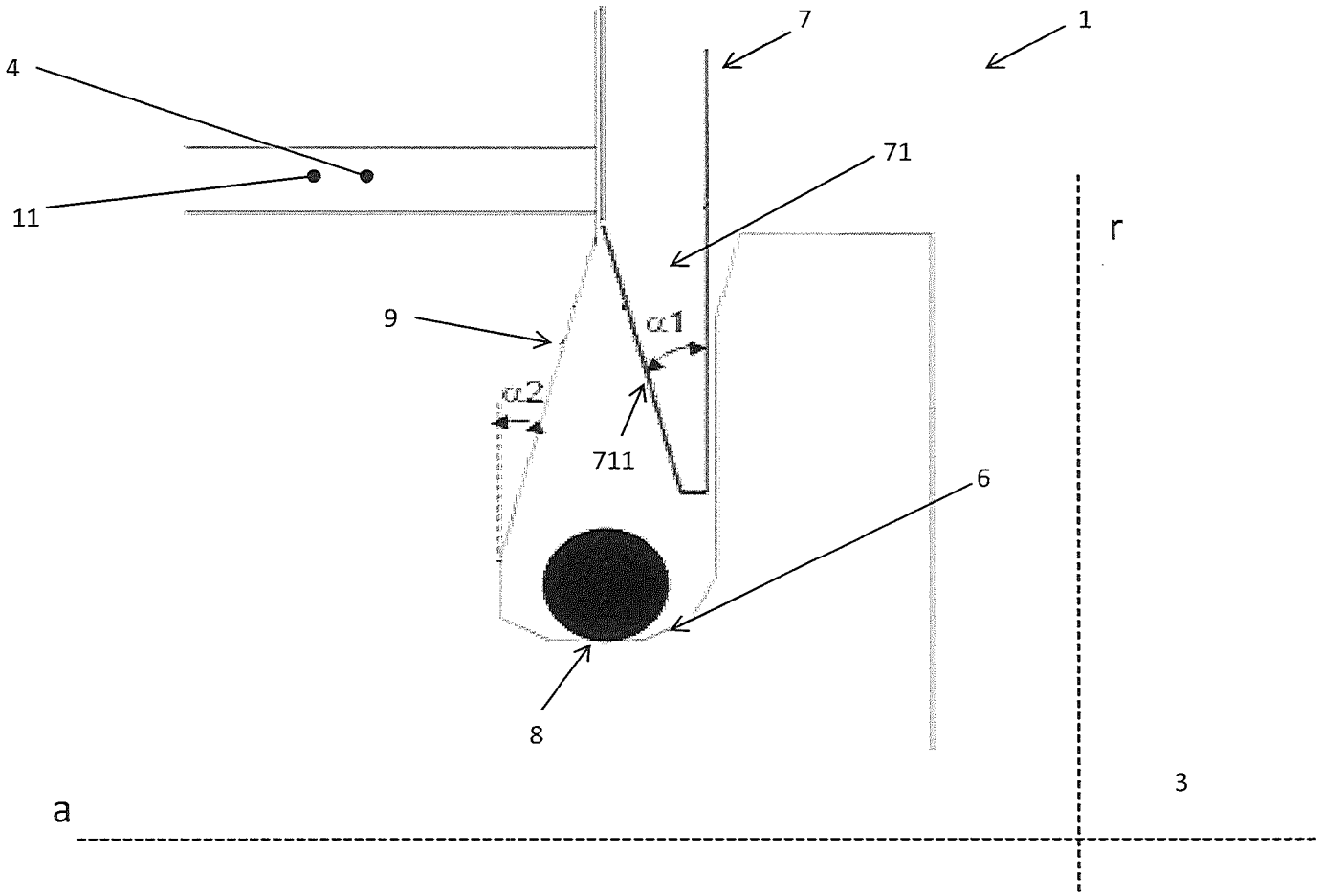
FIG. 4 shows lateral section view of a rotor assembly according to the present invention with the rotor being stationary.

With reference now to following FIG. 4, it is shown a rotor assembly 1 according to a preferred embodiment of the present invention, disclosed here as a non-limiting example. The rotor assembly 1 comprises the rotor body 3, rotatable about the axis a. The rotor body comprises the fir-tree portion 4 (configured to retain a correspondent blade fir-tree portion 11) and the circumferential groove 6 engraved in the rotor body 3 in the proximity of the rotor fir-tree portion 4. The lock plate 7, configured to shield the blade fir-tree portion 4 from hot leakage coming from the rotor adjacent cavity (not shown), is provided. The lock plate 7 comprises a lower portion 71 which is inserted in the groove 6, the latter defining a side wall 9 facing the lock plate lower portion 71. Rotor assembly 1 according to the invention further comprises a sealing wire 8 (visible in lateral section in FIG. 4) located within the circumferential groove 6. Advantageously, the lock plate lower portion 71 and the groove side wall 9 are arranged to define a convergent passage. The sealing wire 8, during operation of the rotor, is subject to centrifugal forces arising during the high-speed rotation of the machinery, and it is moved upwards along the convergent passage until it contacts the lock plate lower portion 71 and the groove side wall 9 in a sealing configuration. This way, the hot leakage passing around the lock plate 7 finds a further obstacle along its path and the tightness of the assembly is thus significantly improved. Furthermore, high centrifugal forces assure a very tight sealing configuration keeping the wire firmly pushed in the convergent passage. FIG. 4 shows the rotor assembly in a resting configuration, with the rotor stationary and the sealing wire 8 being located in an undefined location inside the groove. Preferably, the side wall 9 is aligned with a radial direction r of the rotor body 3 (example not shown). Alternatively, the side wall 9 may be inclined forming an acute angle $\alpha_2$ with the radial direction r. In order to assure that the sealing wire 8, once reached the side wall 9, is actually capable of sliding on it overcoming friction established between the contacted surfaces, angle $\alpha_2$ is preferably selected within the range $0<\alpha 2<\text{arc tan}(\mu f_2)$, wherein $\mu f_2$ is the friction coefficient associated to the side wall surface. The coefficient $\mu f_2$ is calculated according to Coulomb's law of friction. For example, in case both the groove side wall 9 and the sealing wire 8 are made of steel, $\mu f_2$ has a numerical value substantially equal to 0.15.

Additionally or alternatively, the lock plate lower portion 71 may also be shaped in order to establish the convergent passage for reaching a sealing configuration with the wire 8. Advantageously, the lock plate lower portion 71 may be point-shaped. In particular, according to a preferred embodiment, the lock plate lower portion 71 comprises a terminal wall 711, facing the side wall 9, which is inclined forming an acute angle $\alpha_1$ with the radial direction r of said rotor body 3. Preferably, the acute angle is selected in the range $0<\alpha_1<\text{arc tan}(\mu f_1)$, wherein $\mu f_1$ is the friction coefficient associated this time to the terminal wall 711. Coefficient $\mu f_1$ is determined in the same way as for the side wall 9 according to Coulomb's law of friction. It has been showed that providing the point-shaped lock plate lower portion 71 having $\alpha_1$ selected in the sub range $0.1[\text{arc tan}(\mu f_1)]<\alpha_1<0.3[\text{arc tan}(\mu f_1)]$ results in the best sealing performance.

Figure 5B:
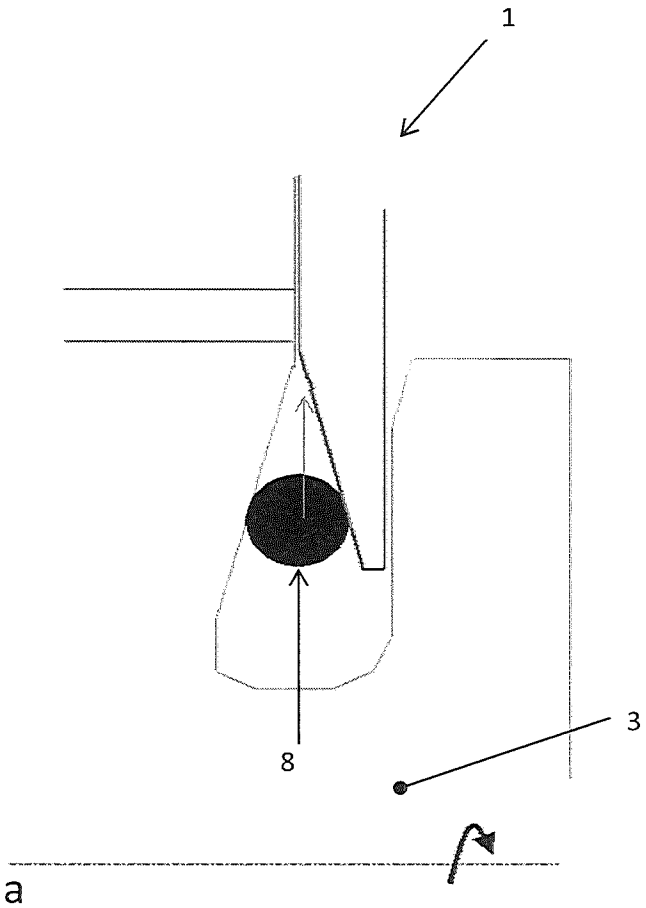
FIGS. 5A and 5B show a lateral section view of the rotor assembly during operation.
Figure 5A:
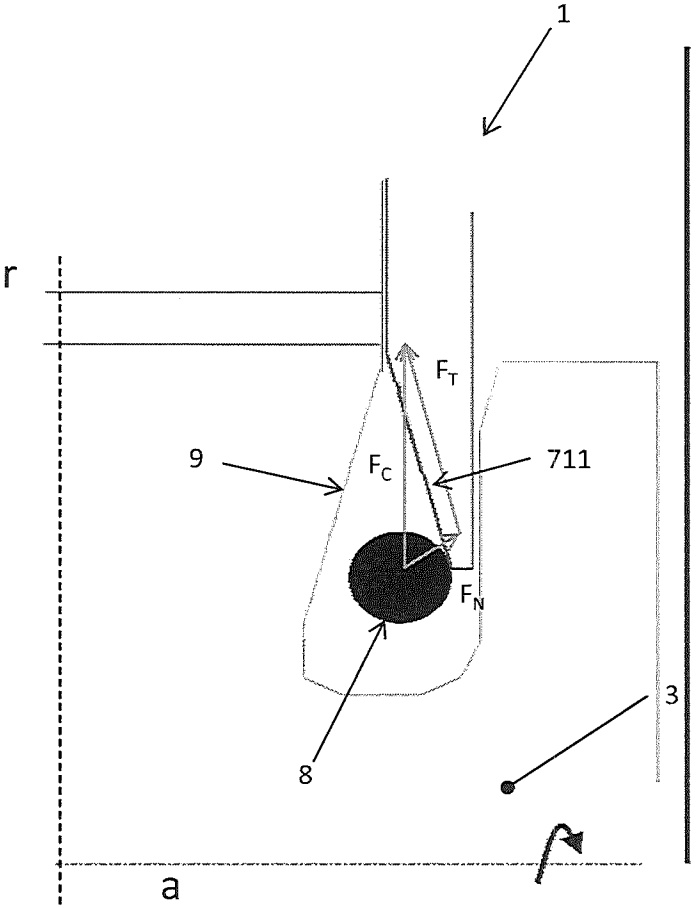

With now reference to the following FIGS. 5A and 5B, it is showed the functioning of the rotor assembly 1 according to the present invention during operation. Due to rotation of the rotor body 3 about the axis a, the sealing wire 8 is subject to a centrifugal force $F_c$ directed along the radial direction r. Once the wire 8 contacts the surfaces of the convergent passage, the geometry on the rotor assembly 1 in terms of selected angles $\alpha_1$ and $\alpha_2$ is such that the force $F_T$ arising at the contact between the wire and the walls of the passage is greater than the friction force, calculated as $F_N \cdot \mu_f$ according to Coulomb's law. In this way, the sealing wire 8, because of the centrifugal force acting on it, slides along the convergent passage until it reaches a sealing configuration depicted in FIG. 5B, such to block leakage.

Figure 6:
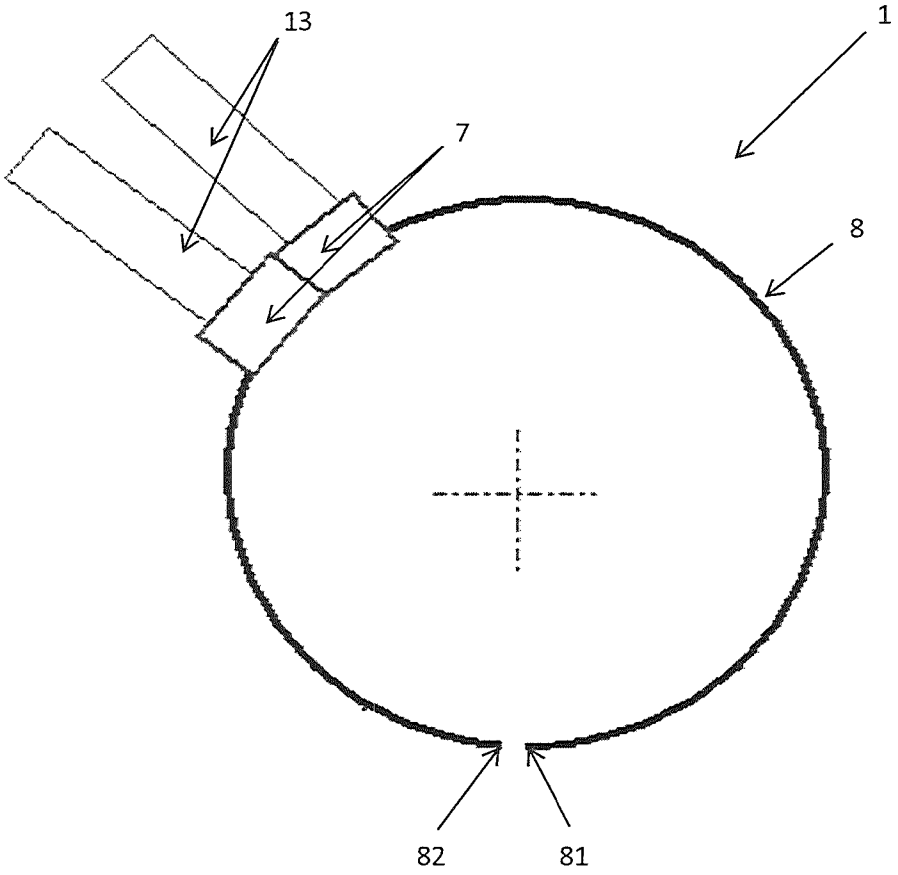
FIG. 6 shows a schematic front view of the rotor assembly according to the present invention.

With now reference to next FIG. 6, it is showed a front schematic view of the sealing wire located within the circumferential groove (not depicted) and, by means of example, two subsequent blades 13, each one associated to a respective lock plate 7. It will be appreciated that the sealing wire will act simultaneously on all the blades belonging to the same axial position along the rotor body (not shown). As shown in the figure, the sealing wire 8 is ring-shaped. Preferably, the wire 8 is made of a metallic material and comprises two free ends 81 and 82, disposed at one angular position and substantially facing each other. The free ends 81 and 82 allow for the expansion of the metallic wire 8 through the circumferential groove such to achieve the sealing configuration during operation as explained above and also facilitate the installation procedure. In particular, the installation is performed as described below. The blades are installed at first. Then the single sealing wire is located in the circumferential groove. Then all the lock plates are installed in sequence, each one being slid towards its final position. For the last lock plate the wire is cut to fit it individually.

Alternatively, the sealing wire may be cut in several pieces, each one for the respective lock plate. Each piece of wire is pre-assembled in a lock plate, the latter comprising a suitable recess hosting the piece of sealing wire. The preassembled lock plates comprising the piece of wires are installed in sequence after the blades have been mounted on the rotor body, in the same way explained above.

It will be appreciated that other materials may be used for the sealing wire other than metal. Alternatively, rope seals may be used or elastic material (which would not require the free ends to allow expansion as for the case of metal). For instance, epoxy, resin, elastomer or rubber materials may be used.

Although the present invention has been fully described in connection with preferred embodiments, it is evident that modifications may be introduced within the scope thereof, not considering the application to be limited by these embodiments, but by the content of the following claims.

The invention claimed is:

1. A rotor assembly for a gas turbine, the rotor assembly comprising:

a rotor body rotatable about an axis a, the rotor body including at least a rotor fir tree portion, configured to receive a correspondent blade fir tree, and a circumferential groove engraved in the rotor body in proximity of said at least one rotor fir tree portion;

a lock plate associated to said rotor fir tree portion having a lock plate lower portion inserted in said circumferential groove, said groove defining a side wall facing said lock plate lower portion; and a sealing wire located within said circumferential groove, wherein said lock plate defines a convergent passage such that said sealing wire, during operation, is configured to be moved by centrifugal forces until it contacts said lower portion of the lock plate and said side wall in a sealing configuration, wherein said acute angle $\alpha_2$ is comprised in the range $0<\alpha_2<\text{arc tan}(\mu_{f2})$, wherein $\mu_{f2}$ is the friction coefficient associated to said side wall.

2. The rotor assembly according to claim 1, wherein said side wall of said circumferential groove is aligned with a radial direction r of said rotor body.

3. The rotor assembly according to claim 1, wherein said side wall is inclined forming an acute angle $\alpha_2$ with a radial direction r of said rotor body.

4. The rotor assembly according to claim 1, wherein said lock plate lower portion is point-shaped.

5. The rotor assembly according to claim 4, wherein said lock plate lower portion comprises a terminal wall facing said side wall which is inclined forming an acute angle $\alpha_1$ with a radial direction r of said rotor body.

6. The rotor assembly according to claim 5, wherein said acute angle $\alpha_1$ is comprised in the range $0<\alpha_1<\text{arc tan}(\mu_{f1})$, wherein $\mu_{f1}$ is the friction coefficient associated to terminal wall.

7. The rotor assembly according to claim 6, wherein $\alpha_1$ is selected in the sub range $0.1\ [\text{arc tan}(\mu_{f1})]<\alpha_1<0.3\ [\text{arc tan}(\mu_{f1})]$.

8. The rotor assembly according to claim 1, wherein said sealing wire is ring-shaped.

9. The rotor assembly according to claim 1, wherein said sealing wire comprise two free ends.

10. The rotor assembly according to claim 1, wherein said sealing wire is made of metal.

11. The rotor assembly according to claim 1, wherein said sealing wire is a rope sealing wire.

12. The rotor assembly according claim 1, wherein said sealing wire is made with an elastic material.

13. The rotor assembly according to claim 1, wherein said elastic material is selected from the group consisting of: epoxy, resin, elastomer, rubber.

14. A gas turbine comprising a rotor assembly according to claim 1.

* * * * *